US006650060B2

(12) United States Patent
Okuda

(10) Patent No.: US 6,650,060 B2
(45) Date of Patent: Nov. 18, 2003

(54) PIXEL DRIVING CIRCUIT FOR LIGHT EMITTING DISPLAY

(75) Inventor: Yoshiyuki Okuda, Saitama (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/050,948

(22) Filed: Jan. 22, 2002

(65) Prior Publication Data

US 2002/0135309 A1 Sep. 26, 2002

(30) Foreign Application Priority Data

Jan. 22, 2001 (JP) ..... P.2001-013096

(51) Int. Cl.[7] ..... G09G 3/10

(52) U.S. Cl. ..... 315/169.1; 315/169.4; 345/76; 345/46

(58) Field of Search ..... 315/169.1, 169.3, 315/169.4; 345/46, 82, 36, 39, 48, 49, 76, 92; 313/500, 505, 400; G09G 3/10

(56) References Cited

U.S. PATENT DOCUMENTS 5,952,789 A 9/1999 Stewart et al. ..... 315/169.4
6,229,506 B1 * 5/2001 Dawson et al. ..... 345/82
6,229,508 B1 * 5/2001 Kane ..... 345/82
6,373,454 B1 * 4/2002 Knapp et al. ..... 345/76
6,498,438 B1 * 12/2002 Edwards ..... 315/169.3
2001/0002703 A1 * 6/2001 Koyama ..... 257/40

* cited by examiner

*Primary Examiner*—Don Wong
*Assistant Examiner*—Trinh Vo Dinh
(74) *Attorney, Agent, or Firm*—Sughrue Mion, PLLC

(57) ABSTRACT

During current programming, one of a drain side and a source side of a driving transistor 12 is once separated from a light emitting element 11 to be driven (switch 17), a model current is injected into the one of the drain side and the source side to be programmed and immediately after the current programming has been completed the one of the drain side and the source side is connected to the side of the light emitting element to be driven so that the light emitting element can be set in a driving mode. The driving current for the light emitting element from the driving transistor 12 is stopped and the model current is injected from the side of the one of the drain and the source so that the corresponding gate voltage is automatically generated. During the current programming operation, driving for the other lines is continued.

7 Claims, 4 Drawing Sheets

PIXEL DRIVING CIRCUIT FOR LIGHT EMITTING DISPLAY

BACKGROUND OF THE INVENTION

1. Field of the Invention

This invention relates to a pixel driving circuit for a light emitting display, and more particularly to a pixel driving circuit which is preferably used in a light-emitting display such as an organic EL (electro-luminescence) display which uses a current driving type transistor for driving a pixel.

2. Description of the Related Art

The light-emitting display such as an organic EL display requires a current driving transistor (TFT) to drive an element arranged for each of pixels. As a generally driving technique, the gate potential of the current driving transistor is controlled to follow a video signal so that the gradation of an image is controlled.

However, large characteristic variations among the transistors for driving an organic EL element lead to variations in a driving current among pixels, which seriously affects the display quality.

The characteristic variations among the driving transistors resultantly lead to the variations in the driving current among the pixels. This deteriorates the quality of a displayed image so that the image appears as if noises were roughly scattered on the image.

On the other hand, in case of adopting a circuit configuration in which a model current is injected form the source side of the driving transistor, while a selected pixel is subjected to current programming, it is necessary to stop current supply to other pixels.

Therefore, since any pixel cannot be set in a driving mode until the current programming operation for all the pixels is completed, it is necessary to wait until the current programming operation for all the pixels is completed. Namely, the period until the current programming operation for all the pixels is a waiting time which does not permits the EL to be driven in timing.

Further, in case that a programmed current value is constant and the light emitting element is turned on/off to exhibit the gradation, it is necessary that one frame is divided into some sub-frames to control the sub-frames at high speed. In the technique according to the related art, the useless waiting time is required, the sub-frame time is correspondingly lengthened and the upper limit of the addressing speed of the entire screen is lowered. Accordingly, the number of the sub-frames contained in one frame is decreased so that the number of exhibitable gradations is lowered to deteriorate the display image quality.

SUMMARY OF THE INVENTION

This invention has been accomplished in view of the above circumstance. This invention intends to provide a pixel driving circuit for a light emitting display in which during current programming, the drain side of a driving transistor is once separated from the light emitting element to be driven, a model current is injected into the drain side so as to program, and the drain side is connected to the side of the light emitting element after the current programming has been completed so that the pertinent pixel can be set in a driving mode, thereby removing a useless waiting time and simplifying the entire driving operation.

In order to solve the above problem, according to a first aspect of the invention, there is provided a pixel driving apparatus for a light emitting display comprising:

a light emitting element;

a driving transistor having a drain, a source, and a gate;

a current programming means for injecting a model current into one of the drain and the source of the driving transistor to program a gate voltage generated in response to the injection of the model current therein; and a light emitting element driving means for connecting the one of the drain and the source of the driving transistor to a side of the light emitting element to be driven after programming of the model current by the current programming means has been completed to drive the light emitting element.

According to the above configuration, the operating of programming the model current causes the pixel to program the model current as a current value so that the driving current can be controlled intentionally regardless of a variation in the characteristic of the driving transistor. Accordingly, variations in the driving current among the pixels, which are ascribable to variations in the transistor characteristic peculiar to the TFT process, can be suppressed so that the display quality can be improved.

Further, while a pixel on a selected line is current-programmed, another pixel on a non-selected line can be set in a driving mode. Therefore, the useless waiting time can be removed to provide a pixel driving circuit for a light emitting display with a simplified entire operation.

According to a second aspect of the invention, there is provided the pixel driving apparatus according to the first aspect of the invention, wherein the current programming means comprises:

a model current source for injecting the model current into the one of the drain and the source of the driving transistor;

a first switching means connected between the light emitting element and the one of the drain and the source of the driving transistor;

a first means for injecting the model current from the model current source into the one of the drain and source of the driving transistor through the first switching means in a state where the light emitting element is separated from the circuit; and a voltage accumulating means for accumulating the gate voltage.

According to a third aspect of the invention, there is provided the pixel driving apparatus according to the second aspect of the invention, wherein the light emitting element driving means comprises:

a second and a third switching means which are connected between the model current source and the one of the drain and the source of the driving transistor and connected between the model current source and a gate of the driving transistor, respectively;

a current supplying means for separating the model current source from the one of the drain and the source of the driving transistor through the second switching means to supply a current to the emitting element by the gate voltage accumulated in the voltage accumulating means; and a second means for holding supply of the gate voltage by the voltage accumulating means through the third switching means until an operation of the current programming means becomes valid.

According to a fourth aspect of the invention, there is provided the pixel driving apparatus according to the first aspect of the invention, wherein the current programming means comprises:

a connecting means for setting the potential of the other of the drain and the source line of the driving transistor in a state where the light emitting element cannot operate to connect the model current source to the one of the drain and the source of the driving transistor;

a first means for injecting the model current from the model current source into the one of the drain and the source of the driving transistor through the connecting means in a state where the light emitting element is separated from the circuit; and a voltage accumulating means for accumulating a gate voltage generated in response to the injection of the model current.

According to a fifth aspect of the invention, there is provided the pixel driving apparatus according to the fourth aspect of the invention, wherein the light emitting element driving means comprises:

a second and a third switching means which are connected between the model current source and the one of the drain and the source of the driving transistor and connected between the model current source and a gate of the driving transistor, respectively;

a current supplying means for separating the model current source from the one of the drain and the source of the driving transistor through the second switching means and setting the potential of the other of the drain and the source line in a state where the light emitting element can operate to supplying a current to the light emitting element by the gate voltage accumulated in the voltage accumulating means; and a second means for holding supply of the gate voltage by the voltage accumulating means through the third switching means until an operation of the current programming means becomes valid.

According to a sixth aspect of the invention, there is provided a pixel driving apparatus for a light emitting display comprising:

a light emitting element;

a driving transistor;

a model current source adapted to supply a model current;

a first switching section adapted to connect/disconnect the one of a drain and a source of the driving transistor and the light emitting element;

a second switching section disposed between the model current source and the one of the drain and the source and adapted to connect/disconnect the model current source and the one of the drain and the source;

a third switching section disposed between the model current source and a gate of the driving transistor and adapted to connect/disconnect the model current source and the gate; and a voltage accumulating section disposed between the third switching section and the gate and adapted to accumulate a voltage between both ends of the driving transistor.

According to a seventh aspect of the invention, there is provided the pixel driving apparatus according to the sixth aspect of the invention, wherein the first switching section is a switching element disposed between the one of the drain and the source and the light emitting element.

According to an eighth aspect of the invention, there is provided the pixel driving apparatus according to the sixth aspect of the invention, wherein the first switching section is a power source connected to the other of the drain and the source of the driving transistor;

the power source applies a low voltage to the other of the drain and the source to disconnect the drain and the light emitting element, the low voltage not enabling to drive the light emitting element; and the power source applies a high voltage to the other of the drain and the source to connect the drain and the light emitting element, the high voltage enabling to drive the light emitting element.

According to a ninth aspect of the invention, there is provided the pixel driving apparatus according to the seventh aspect of the invention, wherein the first and second switching sections and the switching element are transistors.

DETAILED DESCRIPTION OF THE PREFERRED EMBODIMENTS

Figure 1:
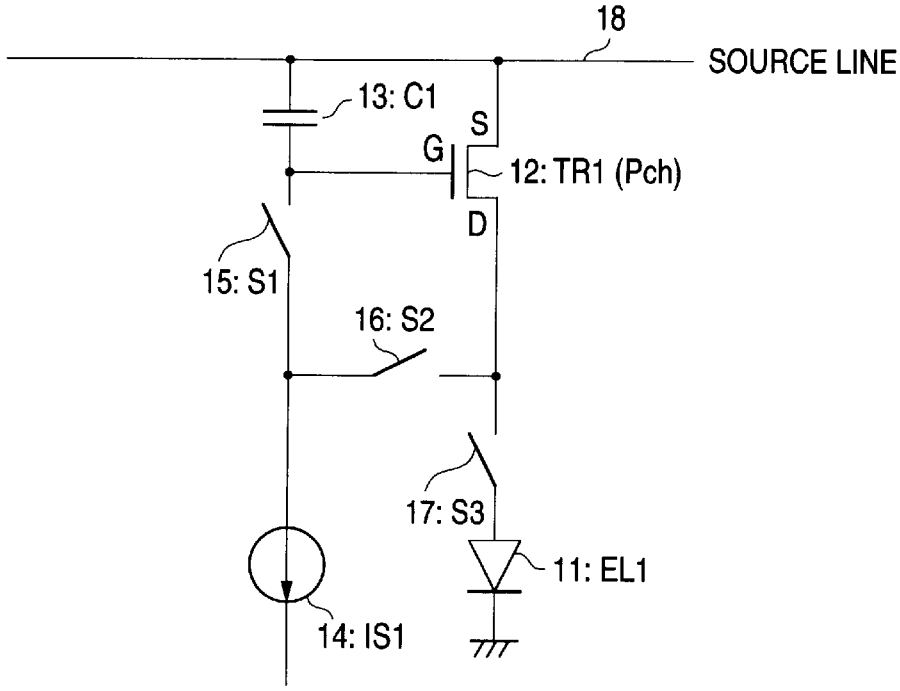
FIG. 1 is a schematic configuration view showing a pixel driving circuit for a light emitting display according to an embodiment of this invention.

FIG. 1 is a schematic configuration view showing a pixel driving circuit for a light emitting display according to an embodiment of this invention.

In FIG. 1, reference numeral 11 denotes an organic EL element (EL1), reference numeral 12 denotes a driving transistor (TR1), reference numeral 13 denotes a capacitor (C1), and reference numeral 14 denotes a model current source (IS1). Here, it is assumed that the driving transistor 12 is a P-channel current driving type TFT and a drain D thereof is connected to an organic EL element 1 via switch (S3) 17. A capacitor 13 for holding a gate voltage is disposed and connected between a gate G of the transistor 12 and a source line 18. A switch (S1) 15 is disposed and connected between the model current source 14 and the gate G. A switch (S2) 16 is disposed and connected between the model current source 14 and drain D.

Now, the model current source 14 is provided externally and an operation mode is switched between a model current programming mode and an EL driving mode by the switches 15 to 17 so that the operation described later is executed.

First, an explanation will be given on the model current programming mode. First, the switch 17 set at an "OFF" state so that the organic EL element 11 is separated from the circuit, whereby the model current I1 from the model current source 14 is injected into the drain of the driving transistor 12. At this time, the other switches 15 and 16 both are set at an "ON" state. In this case, the model current I1 cannot flow through paths other than the drain of the driving transistor 12. Therefore, the driving transistor 12 necessarily generates a gate voltage so that the model current I1 flows as a drain current.

In this way, owing to such a gate voltage to cause the model current I1 to flow, the driving transistor 12 attempts to supply the model current I1 to the model current source 14 as if the model current source 14 was a load for the driving transistor 12. The gate voltage is also charged the capacitor 13.

Next, an explanation will be given on the organic EL operation mode. The switch 16 set at the OFF state, the model current source 14 is separated from the circuit and the switch 17 is closed to connect the driving transistor 12 to the organic EL element 11, whereby, owing to the gate voltage charged in the capacitor 13, the driving transistor 12 attempts to supply the model current I1 as the drain current so that the model current I1 flows into the organic EL element 11. Simultaneously, the switch 15 is turned OFF, whereby the gate voltage charged in the capacitor 13 is confined and held until the next model current programming mode becomes valid.

Figure 2:
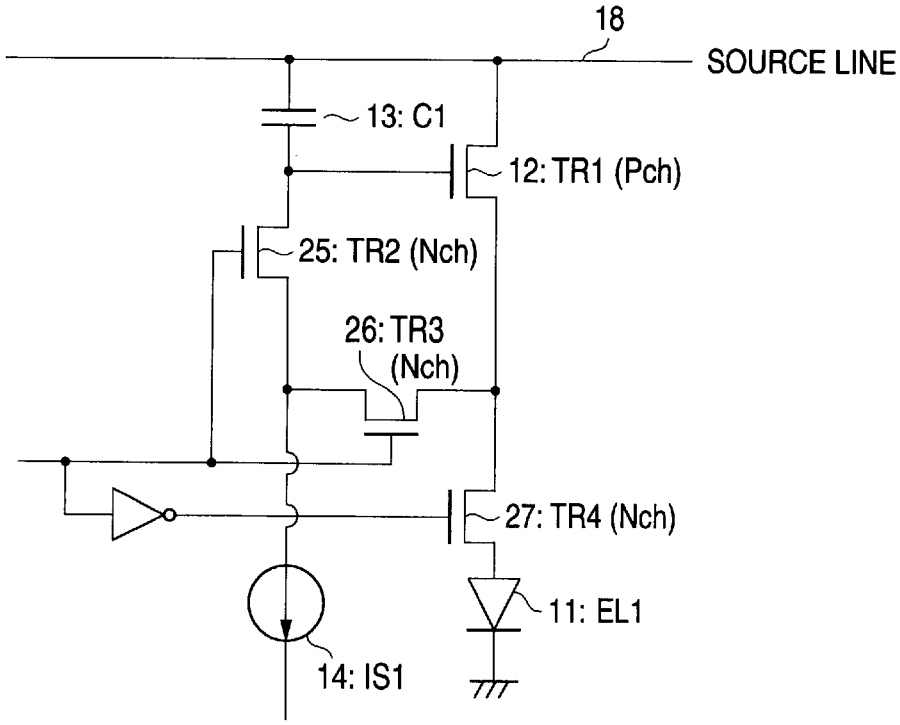
FIG. 2 is a view showing a circuit configuration when switches in the embodiment shown in FIG. 1 are replaced with transistors.

FIG. 2 is a circuit diagram of an embodiment when the switches 15 to 17 shown in FIG. 1 are designed using actual transistors. In FIG. 2, like reference numerals refer to like circuit elements in FIG. 1.

The switch 15 in FIG. 1 corresponds to a switching transistor (TR2) 25; the switch 16 in FIG. 1 corresponds to a switching transistor (TR3) 26; and the switch 17 in FIG. 1 corresponds to a switching transistor (TR4) 27. Now it is assumed that each of these switching transistors is constructed of an N-channel transistor.

The operation of the circuit shown in FIG. 2, which is the same as the embodiment shown in FIG. 1, will not be explained to avoid repetition. The state transition of the transistors 25 to 27 in each of the operation modes (model current programming mode/organic EL driving mode) is shown in Table 1.

TABLE 1

| | State transition of the transistors | | |
|---|---|---|---|
| Operation Mode | TR2 (S1) | TR3 (S2) | TR4 (S3) |
| Model current Programming Mode | "ON" | "ON" | "OFF" |
| Organic EL Driving Mode | "OFF" | "OFF" | "ON" |

Figure 3:
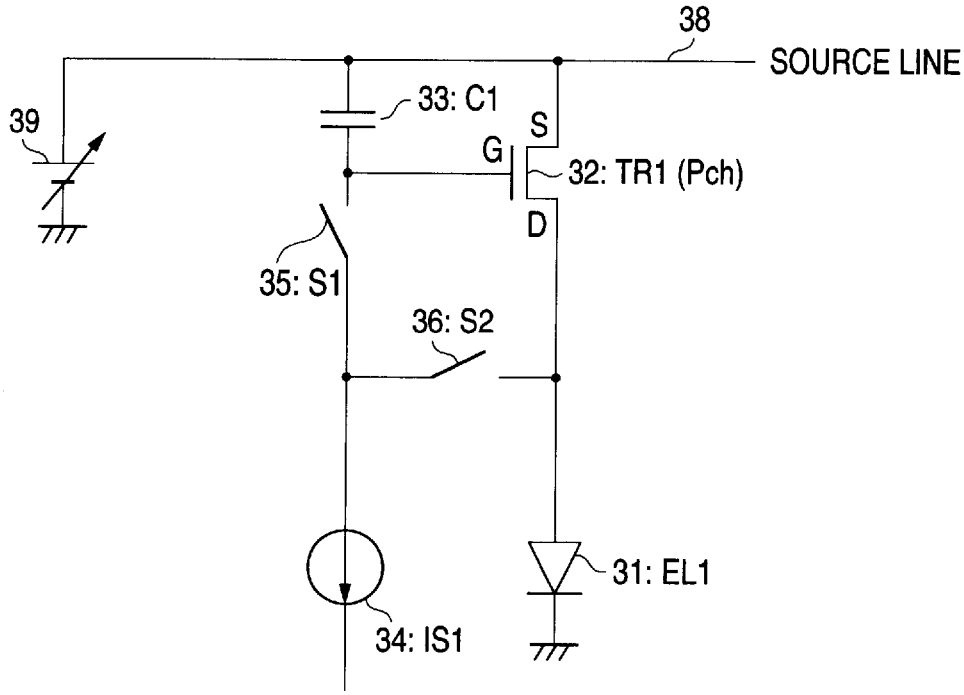
FIG. 3 is a schematic configuration view showing a pixel driving circuit for a light emitting display according to another embodiment of this invention.

FIG. 3 is a schematic configuration view showing a pixel driving circuit for a light emitting display according to another embodiment of this invention.

In FIG. 3, reference numeral 31 denotes an organic EL element (EL1), reference numeral 32 denotes a driving transistor (TR1), reference numeral 33 denotes a capacitor (C1), and reference numeral 34 denotes a model current source (IS1). Here, it is assumed that the driving transistor 32 is a P-channel current driving type TFT and a drain D thereof is connected to an organic EL element 31. The capacitor 33 for holding a gate voltage is disposed and connected between a gate G of the transistor 32 and a source line 38. A switch (S1) 35 is disposed and connected between the model current source 34 and the gate G. A switch (S2) 36 is connected between the model current source 34 and drain D.

It should be noted that the source line 38 is biased by a bias power source 39.

Now, the model current source 34 is provided externally and an operation mode is switched between a model current programming mode and an EL driving mode by the potential of the source line 38 and the switches 35, 36, whereby the operation described later is executed.

First, an explanation will be given on the model current programming mode. If the potential of the source line 38 is set at a "LOW" state in the vicinity of a GND level, the current IS1 from the model current source 34 is connected to the drain of the driving transistor 32, since the organic EL element 31 has the potential difference between both ends thereof is lower than "ON" level, the organic EL element is not supplied with the current. The model current I1 flows into only the drain of the driving transistor 32. The driving transistor 32 generates a gate voltage so that the model current I1 flows as a drain current.

Accordingly, owing to such a gate voltage, the driving transistor 32 attempts to supply the model current I1 to the model current source 34 as if the model current source 34 was a load for the driving transistor 32. The gate voltage is also charged the capacitor 33.

Next, an explanation will be given on the organic EL operation mode. First the switch 36 is set at the OFF state, the model current source 34 is separated from the circuit, and the potential of the source line 38 is set at a "HIGH" state higher than "ON" level of the organic EL element 31. Then, owing to the gate voltage charged in the capacitor 33, the driving transistor 32 attempts to continue supplying the model current I1 as the drain current so that the model current I1 flows into the organic EL element 31. Simultaneously, the switch 35 is turned OFF, whereby the gate voltage charged in the capacitor 33 is confined and held until the next model current programming mode becomes valid.

Incidentally, during the model current programming mode, when the source potential is lowered to a minus level, the organic EL element 31 is reverse-biased so that the organic EL element 31 can be refreshed.

Figure 4:
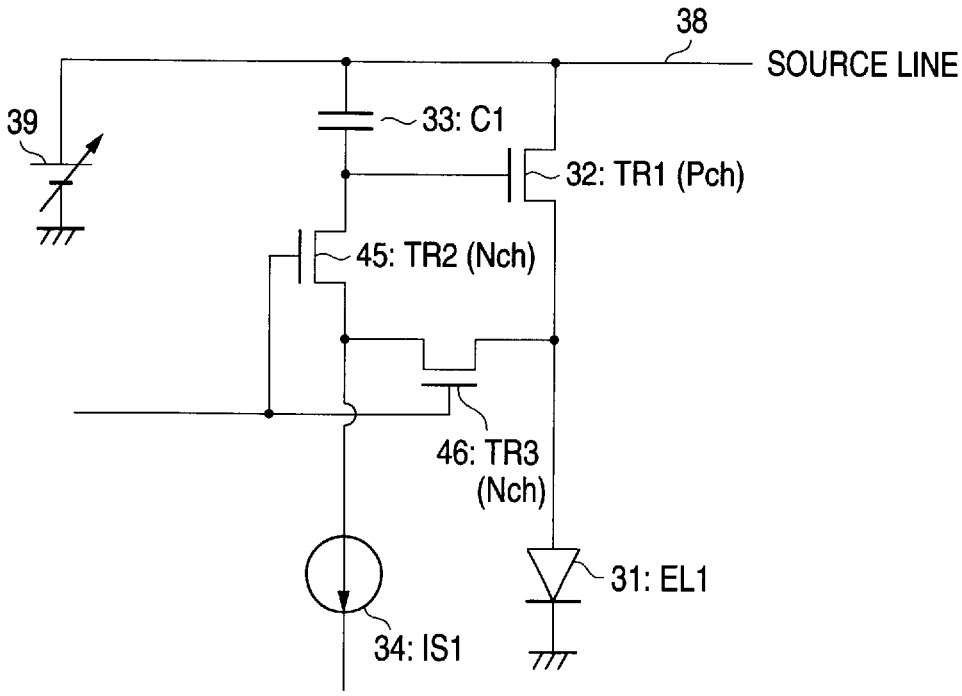
FIG. 4 is a view showing a circuit configuration when switches in the embodiment shown in FIG. 3 are replaced with transistors.

FIG. 4 is a circuit diagram of an embodiment when the switches 35 and 36 shown in FIG. 3 are designed using actual transistors. In FIG. 4, like reference numerals refer to like circuit elements in FIG. 3.

The switch 35 in FIG. 3 corresponds to a switching transistor (TR2) 45; and the switch 36 in FIG. 3 corresponds to a switching transistor (TR3) 46. Now it is assumed that each of these switching transistors is constructed of an N-channel transistor.

An operation of the circuit shown in FIG. 4, which is the same as the embodiment shown in FIG. 3, will not be explained to avoid repetition. The state transition of the transistors 45 and 46 and the potential of the source line for each of the operation modes (model current programming mode/organic EL driving mode) is shown in Table 2.

TABLE 2

| Operation Mode | State transition of the transistors and source line potential | | |
|---|---|---|---|
| | TR2 (S1) | TR3 (S2) | Source Potential |
| Model Current Programming Mode | "ON" | "ON" | "LOW" |
| Organic EL Driving Mode | "OFF" | "OFF" | "HIGH" |

Figure 5:
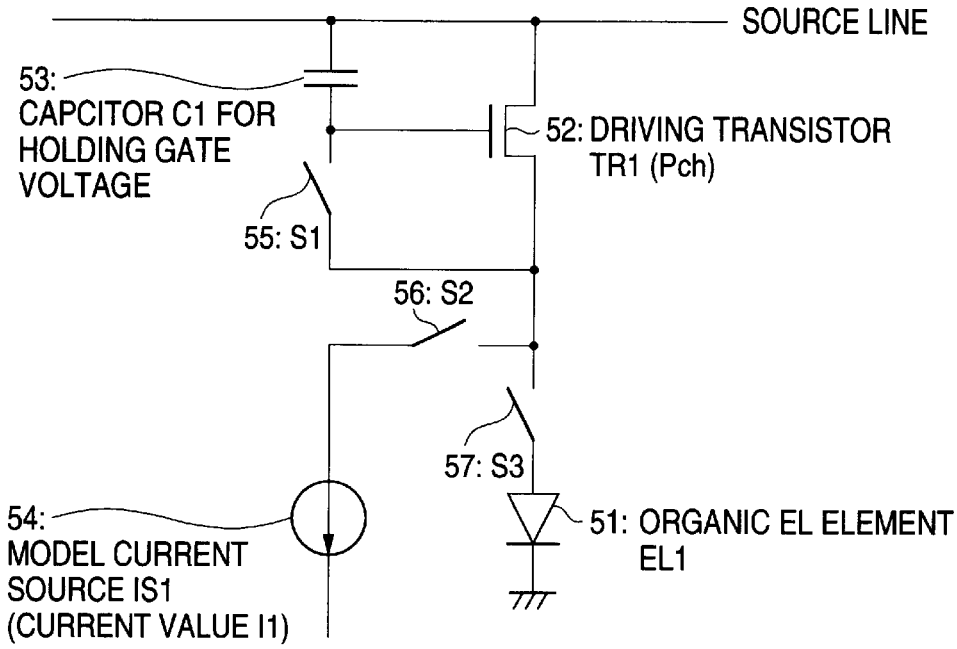
FIG. 5 is a schematic configuration view showing a pixel driving circuit for a light emitting display according to still another embodiment of this invention.
Figure 6:
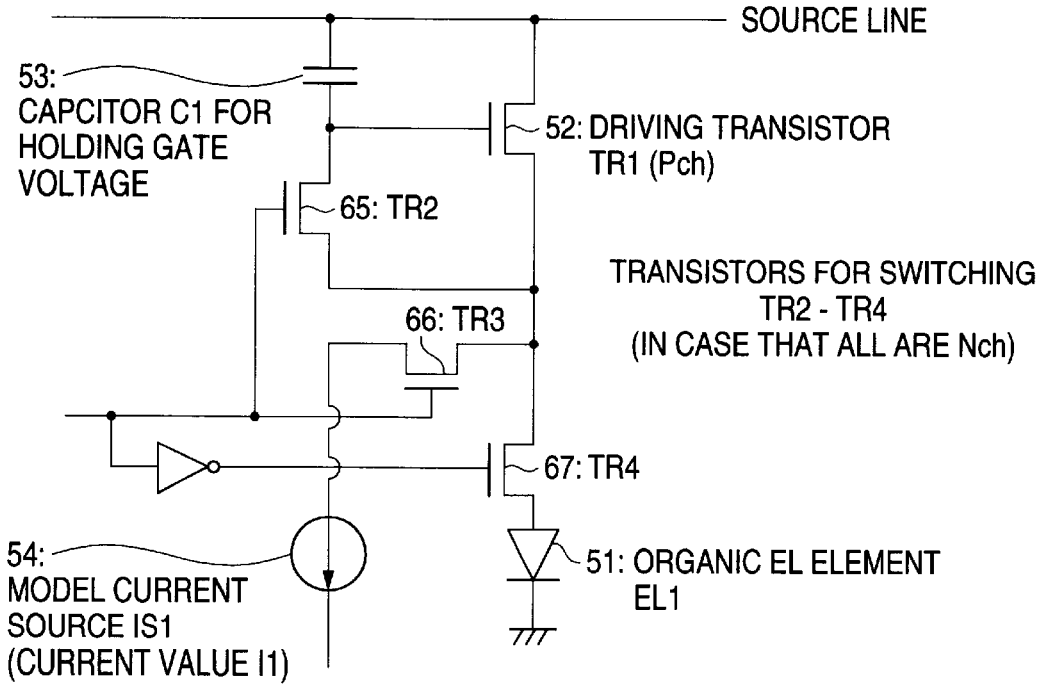
FIG. 6 is a view showing a circuit configuration when switches in the embodiment shown in FIG. 5 are replaced with transistors.
Figure 7:
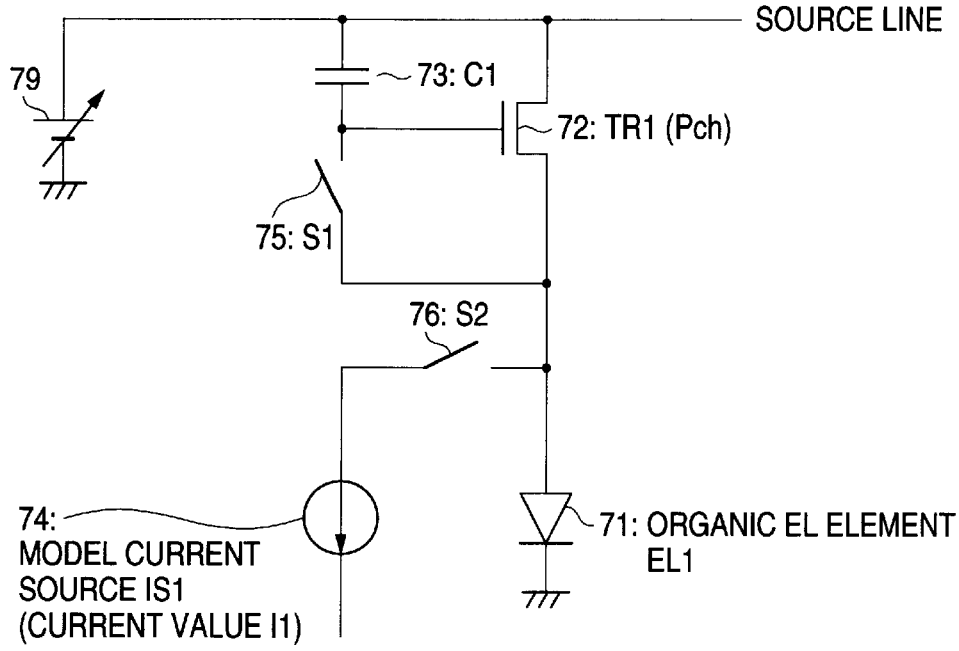
FIG. 7 is a schematic configuration view showing a pixel driving circuit for a light emitting display according to a further embodiment of this invention.
Figure 8:
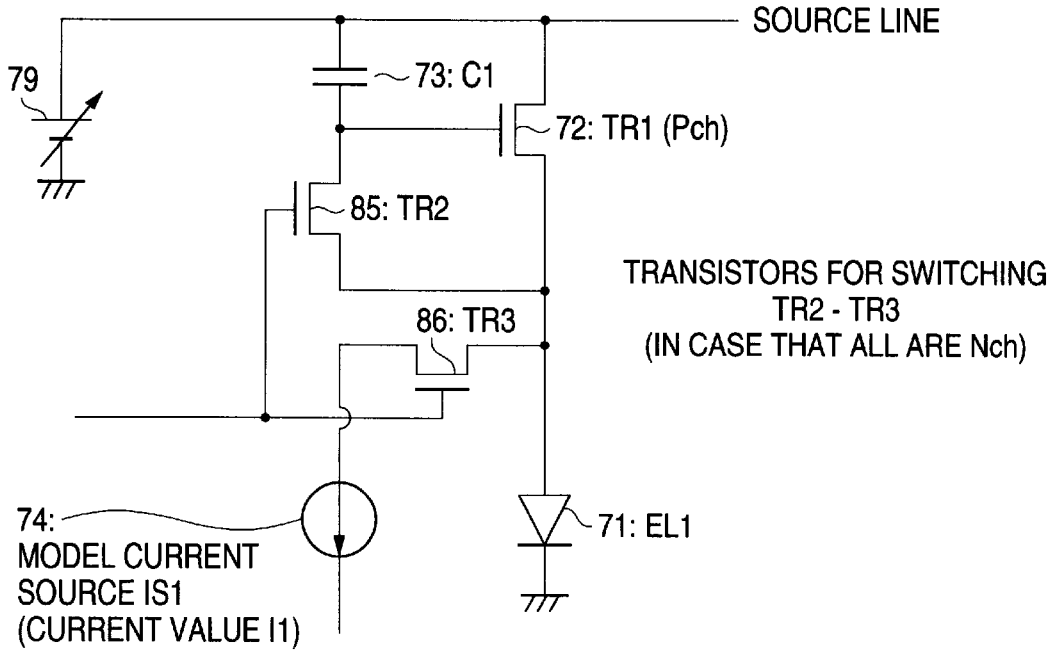
FIG. 8 is a view showing a circuit configuration when switches in the embodiment shown in FIG. 7 are replaced with transistors.

FIGS. 5 and 7 are schematic configuration views showing a pixel driving circuit for a light emitting display according to further embodiments of this invention. FIGS. 6 and 8 are circuit diagrams of embodiments when the switches 55(75), 56(76) and 57 shown in FIGS. 5 and 7 are designed using actual transistors, respectively.

In FIG. 6(8), like reference numerals refer to like circuit elements in FIG. 5(7). These embodiments are different from the embodiments shown in FIGS. 1(2) and 3(4) in a manner of connecting the switches 55(75), 56(76) and 57. The other connecting configuration and the operation are similar to those in the embodiments shown in FIGS. 1(2) and 3(4). They will not be explained herein to avoid repetition.

All the embodiments described above are not deviated from the scope of the pixel driving circuit for a light emitting display comprising a current programming means for injecting a model current into one of a drain and source of a driving transistor to be programmed in a state where the one of the drain and source is separated from a light emitting element to be driven and a light-emitting-element driving means for connecting the one of the drain and the source of the driving transistor to a side of the light emitting element when programming of the model current by the current programming means has been completed to drive the light emitting element.

As understood from the above description, in accordance with this invention, while a pixel on a selected line is current-programmed, another pixel on a non-selected line can be set in a driving mode. Therefore, in comparison with U.S. Pat. No. 5,952,789 assigned to Sarnoff Corp. at the same frame frequency, the invention can lengthen the driving time longer so that the real light-emitting luminance of a light-emitting element to realize the same luminance in a visual sense can be lowered. Accordingly, the life of the light emitting element can be improved and the current of the driving transistor can be reduced so that burden for driving transistor can be relaxed and the size thereof can be reduced.

In case that the gradation is exhibited by the pulse density by on-off controlling the light emitting element with a programmed current being constant, high speed control is required with one frame divided into some sub-frames. However, in accordance with this invention, as described above, it is not necessary to set a useless waiting time so that it is possible to cancel the phenomenon that the number of exhibitable gradations is lowered to deteriorate the display image quality.

In accordance with this invention, during current programming, the drain side of a driving transistor is once separated from the light emitting element to be driven, a model current is injected into the drain or source side so as to be programmed and the drain or source side is connected to the side of the light emitting element immediately after the current programming has been completed so that a pertinent pixel can be set in a driving mode. In this way, the operating of programming the model current causes the pixel to program the model current as a current value so that the driving current can be controlled intentionally regardless of a variation in the characteristic of the driving transistor. Accordingly, variations in the driving current among the pixels, which is ascribable to variations in the transistor characteristic peculiar to the TFT process, can be suppressed so that the display quality can be improved.

Further, while a pixel on a selected line is current-programmed, another pixel on a non-selected line can be set in the driving mode. Therefore, the useless waiting time can be removed, thereby providing a pixel driving circuit for a light emitting display with a simplified entire operation.

Incidentally, by lowering the source potential to a minus level during the model current programming mode, the light emitting element is automatically reverse-biased, thereby also providing an additive effect of refreshing the light emitting element.

What is claimed is:

1. A pixel driving apparatus for a light emitting display comprising:

a light emitting element;

a driving transistor having a drain, a source, and a gate;

a current programming means for injecting a model current into one of the drain and the source of the driving transistor to program a gate voltage generated in response to the injection of the model current therein; and a light emitting element driving means for connecting the one of the drain and the source of the driving transistor to a side of the light emitting element to be driven after programming of the model current by the current programming means has been completed to drive the light emitting element;

wherein the current programming means comprises:

a model current source for injecting the model current into the one of the drain and the source of the driving transistor;

a first switching means connected between the light emitting element and the one of the drain and the source of the driving transistor;

a first means for injecting the model current from the model current source into the one of the drain and source of the driving transistor through the first switching means in a state where the light emitting element is separated from the circuit; and a voltage accumulating means for accumulating the gate voltage; and wherein the light emitting element driving means comprises:

a second and a third switching means which are connected between the model current source and the one of the drain and the source of the driving transistor and connected between the model current source and a gate of the driving transistor, respectively;

a current supplying means for separating the model current source from the one of the drain and the source of the driving transistor through the second switching means to supply a current to the emitting element by the gate voltage accumulated in the voltage accumulating means; and a second means for holding supply of the gate voltage by the voltage accumulating means through the third switching means until an operation of the current programming means becomes valid.

2. A pixel driving apparatus for a light emitting display comprising:

a light emitting element;

a driving transistor having a drain, a source, and a gate; and a current programming means for injecting a model current into one of the drain and the source of the driving transistor to program a gate voltage generated in response to the injection of the model current therein;

wherein the current programming means comprises:

a connecting means for setting the potential of the other of the drain and the source of the driving transistor between a state where the light emitting element operates and a state where the light emitting element does not operate;

a first means for injecting the model current from a model current source into the one of the drain and the source of the driving transistor in the state where the light emitting element does not operate; and a voltage accumulating means for accumulating a gate voltage generated in response to the injection of the model current.

3. The pixel driving apparatus according to claim 2 further comprising:

a first and a second switching means which are connected between the model current source and the one of the drain and the source of the driving transistor and connected between the model current source and a gate of the driving transistor, respectively;

a current supplying means for separating the model current source from the one of the drain and the source of the driving transistor through the second switching means and setting the potential of the other of the drain and the source line in a state where the light emitting element operates to supplying a current to the light emitting element by the gate voltage accumulated in the voltage accumulating means; and a second means for holding supply of the gate voltage by the voltage accumulating means through the third switching means until an operation of the current programming means becomes valid.

4. A pixel driving apparatus for a light emitting display comprising:

a light emitting element;

a driving transistor;

a model current source adapted to supply a model current;

a first switching section adapted to connect/disconnect one of a drain and a source of the driving transistor and the light emitting element;

a second switching section disposed between the model current source and the one of the drain and the source and adapted to connect/disconnect the model current source and the one of the drain and the source;

a third switching section disposed between the model current source and a gate of the driving transistor and adapted to connect/disconnect the model current source and the gate; and a voltage accumulating section disposed between the third switching section and the gate and adapted to accumulate a voltage between both ends of the driving transistor.

5. The pixel driving apparatus according to claim 4, wherein the first switching section is a switching element disposed between the one of the drain and the source and the light emitting element.

6. The pixel driving apparatus according to claim 5, wherein the first and second switching sections and the switching element are transistors.

7. The pixel driving apparatus according to claim 4, wherein the first switching section is a power source connected to the other of the drain and the source of the driving transistor;

the power source applies a low voltage to the other of the drain and the source to disconnect the drain and the light emitting element, the low voltage not enabling to drive the light emitting element; and the power source applies a high voltage to the other of the drain and the source to connect the drain and the light emitting element, the high voltage enabling to drive the light emitting element.

* * * * *